United States Patent [19]

Parquet et al.

[11] 4,063,489

[45] Dec. 20, 1977

[54] AUTOMATIC HYDRAULIC SHUT-OFF SYSTEM

[75] Inventors: Donald James Parquet; Carl Oluf Pedersen, both of Burlington, Iowa

[73] Assignee: J. I. Case Company, Racine, Wis.

[21] Appl. No.: 672,133

[22] Filed: Mar. 31, 1976

[51] Int. Cl.[2] ..... F15B 11/08; F15B 13/042

[52] U.S. Cl. ..... 91/445; 137/460; 137/498

[58] Field of Search ..... 91/445, 433; 137/460, 137/498; 73/40.5

[56] References Cited

U.S. PATENT DOCUMENTS

| | | | |
|---|---|---|---|
| 740,882 | 10/1903 | Locke | 137/46 D |
| 820,598 | 5/1906 | Petersen | 137/46 D |
| 2,012,351 | 8/1935 | Riney et al. | 137/46 D X |
| 2,266,533 | 12/1941 | Brisbane et al. | 137/46 D |
| 2,694,408 | 11/1954 | McRae | 137/46 D |
| 2,964,016 | 12/1960 | Talak | 91/42 D |
| 3,695,094 | 10/1972 | Hulme | 73/40.5 R |
| 3,880,181 | 4/1975 | Feroy | 91/445 X |

*Primary Examiner*—Irwin C. Cohen
*Attorney, Agent, or Firm*—Arthur J. Hansmann

[57] ABSTRACT

A hydraulic safety system for use with a hydraulic valve and a work apparatus which is retained under hydraulic pressure even when the hydraulic line is broken inadvertently. A lock valve is connected in the line and senses the loss of hydraulic pressure, and the valve is actuated in response to the pressure drop and retains the work apparatus in a pressurized condition to thereby avoid undesired movement in response to the loss of pressure.

4 Claims, 7 Drawing Figures

AUTOMATIC HYDRAULIC SHUT-OFF SYSTEM

This invention relates to a hydraulic safety system of the type utilized in apparatus which incorporates a hydraulic valve and a working hydraulic motor or piston arrangement, all arranged with a safety mechanism useful in the event the hydraulic line is broken or the hydraulic pressure is reduced inadvertently.

BACKGROUND OF THE INVENTION

The prior art is already aware of safety mechanisms, such as safety controls, for use in hydraulic equipment wherein the hydraulic line is broken or the hydraulic pump is turned off. One such example of a control is shown in U.S. Pat. No. 2,964,016, and that patent is showing apparatus useful in retaining a lifted load in an elevated position even though the hydraulic pressure is inadvertently reduced. The present invention is an improvement upon this type of apparatus, and it accomplishes the arrangement of a hydraulic safety system which is self-actuating and is reliable and operative in the event that the hydraulic pressure is inadvertently reduced, and the lifted load or the like will not be immediately released in response to the reduced hydraulic pressure.

Another object of this invention is to provide a hydraulic safety system which is simplified in its apparatus and in its installation, and to provide one which can be readily and easily installed in a hydraulic system and is constantly available and is reusable for locking the system in an operative position when the hydraulic pressure is inadvertently reduced, such as by having a hydraulic line break. As such, the present invention provides a fail-safe system, for the purposes mentioned above.

Still further, the present invention provides a hydraulic safety system which is automatically operative, under the conditions and for the reasons mentioned above, and one which can also be manually operated to release it from a locked position wherein the work load is being supported even though the hydraulic line or the like has failed to retain hydraulic pressure. In accomplishing this object, the manual release is arranged so that it can be operated to gradually release the hydraulic pressurizing and sustaining of the lifted load, for instance, and thus the safety lock or like element of this invention provides for automatic safety and also for controlled manual release of same.

Other objects and advantages will become apparent upon reading the following description in light of the accompanying drawings.

DETAILED DESCRIPTION OF THE PREFERRED EMBODIMENTS

Figure 1:
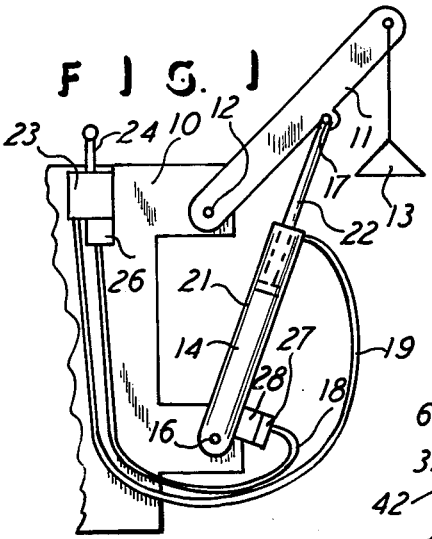
FIG. 1 is a side elevational view of hoisting apparatus with the elements of this invention.

FIG. 1 shows an arrangement of hoisting apparatus, and this may be in the nature of a conventional type of backhoe equipment mounted on a tractor 10 and having lift arm 11 pivotal thereon about a shaft 12. The load is designated 13 and is of course lifted by the pivotal movement of the arm 11, and a cylinder assembly 14 is pivotally mounted on the tractor 10 at a shaft 16 and is pivotally connected to the arm 11 at a shaft 17. Thus extension and contraction of the cylinder assembly 14 will of course raise and lower the arm 11 and thereby raise and lower the load 13 which may actually be a backhoe bucket or a like load which one skilled in the art will readily comprehend according to the disclosure herein and the showing in FIG. 1.

FIG. 1 further shows that the arm 11 is under the influence of the fluid cylinder assembly 14, and this is preferably a hydraulic system and will therefore be described as such. Hydraulic lines or hoses 18 and 19 connect into opposite ends of the cylinder 21 of the assembly 14, and thus the cylinder rod 22 will extend and contract relative to the cylinder 21, according to fluid pressures introduced into the cylinder 21 and through the hoses 18 and 19. A control valve 23 operated through a handle 24 is mounted on the tractor or support 10 and the hoses 18 and 19 connect with the valve 23. A fluid pressure sensor 26 is in fluid-flow communication with the valve 23 and the hose 18, and another fluid pressure sensor 27 and a fluid valve 28 are in fluid-flow communication between the hose 18 and one end of the cylinder 21.

With the arrangement shown in FIG. 1, it will be seen and understood that the valve 28 is mounted and located adjacent the cylinder 21 and at the head end of the cylinder 21 such that if there is a break in the hydraulic line 18, then closing of the fluid valve 28 will prevent the cylinder assembly 14 from contracting and thereby permitting the load 13 to fall. With this desirable consequence, the load 13 will be held in its elevated position even though there is a break in the hydraulic hose 18 or any place else in the hydraulic system beyond the valve 28 as it relates to the cylinder 21.

Figure 2:
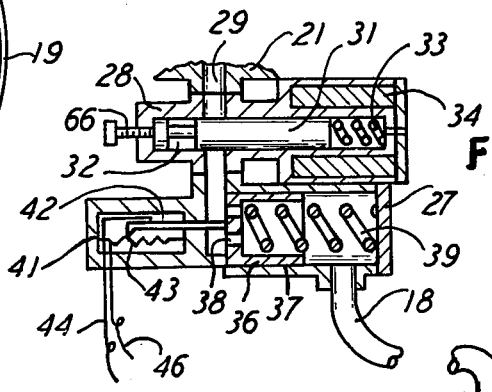
FIGS. 2 and 3 are sectional views of the valves, on an enlarged scale, shown in FIG. 1.

FIG. 2 shows the fragment of the cylinder 21, and the valve 28 is suitably mounted thereon such that a fluid passageway 29 extends between the cylinder 21 and the valve 28, and a spool-type of valve closure 31 is disposed within the valve 28 and has a fluid passageway 32 which can align with the passageway 29, such as upon shifting of the spool 31 to the right and against the spring 33, as viewed in FIG. 2. Of course in the leftward shifted position shown in FIG. 2, the valve 28 is shut off and is therefore retaining the fluid pressure in the cylinder 14 and is thereby preventing the load 13 from falling, as desired. Also incorporated with or connected to the hydraulic valve 28 are a conventional electric solenoid 34 and a hydraulic responsive flow controlled and electric variable resistance apparatus 37. Thus, in a conventional arrangement of providing a solenoid type of valve, the usual and conventional solenoid 34 is provided for inducing axial movement of the spool 31, according to the electric energy in the solenoid 34 to thereby open and close the hydraulic spool 31 and permit flow through the passageways 29 which are actually in flow communication with the hose 18 through the apparatus 37. Thus the apparatus 37 is shown to include a slidable piston 36 which has orifices 38 therein and which is biased by a spring 39. An electric potentiometer 41 is included in the apparatus 37 and has one electric member 42 movable with the piston 36 and has the other electric side 43 affixed in the apparatus 36, in a conventional arrangement. Electric wires 44 and 46 respectively connect with the potentiometer sides 42 and 43 and extend therefrom, as shown.

With the arrangement shown in FIG. 2, when there is backflow from the passages 29 and toward the hose 18, such as when the hose 18 breaks and the flow is of a considerable and instantaneous form, then the piston 36 will slide to the right in response to the flow in that direction and this will change the setting on the potentiometer, and, according to the then instant condition of the sensor 26 as shown and described in connection with FIG. 3, the valve spool 31 may move to its closed position shown, as hereinafter described.

Figure 3:
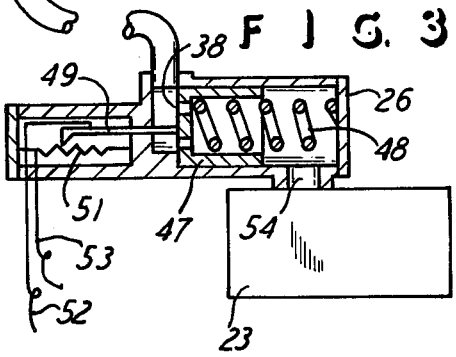

FIG. 3 shows the sensor 26 and it has a piston 47 slidable therein against the influence of a spring 48, and it also has a potentiometer in the form of one electric element 49 and the fixed electric element 51 and the respective connecting wires 52 and 53, and of course the element 49 is connected with the piston 47 to move therewith and thus change the electric condition in the potentiometer described. FIG. 3 also shows that the sensor 26 is in flow communication, through the passageway 54, with the valve 23.

Figure 4:
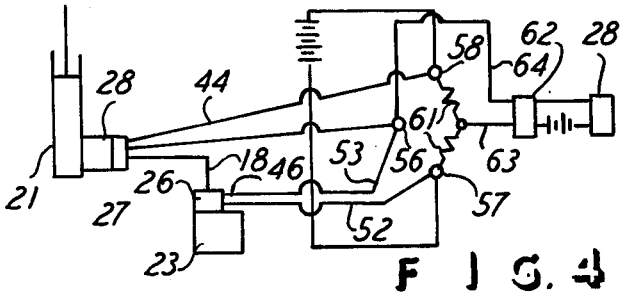
FIG. 4 is a diagrammatic view of the valves and the electric circuit connected therewith.

Thus, with the aforementioned description, it will be understood that if there is a break in the hose 18, then the movement of the piston 36 would be greater than the movement of the piston 47, and the differential in the movement would be registered on the respective electrical elements in each sensor 26 and 27. That difference in the electric apparatus of each of the sensors can be detected and can thereby be impressed upon the solenoid 34 for closing the spool 31 and thereby avoid having the load 13 fall to the ground. FIG. 4 shows the electric schematic arrangement, and it will here be seen that the valve 23 and the sensors 26 and 27 are connected through the hose 18 and are connected with the cylinder assembly 21. Also, the sensors 26 and 27 are electrically connected into a bridge and are connected to a common connector 56 and to opposite sides 57 and 58 of resistors 61. Also, a latching electric relay 62, of a conventional and well-known design, is connected to the bridge through electric lines 63 and 64, and the latching relay is then schematically shown to be connected to the controls for the solenoid valve 28, and that is simply diagrammatically shown in FIG. 4, and one skilled in the art will understand the disclosure and the arrangement and connection such that there is the electric latching relay 62 operative on the solenoid 34 for controlling the valve 28. Such control is of course in accordance with the electrical difference between the sensors 26 and 27, as established by the difference in the then back flow through the respective sensors 26 and 27.

Accordingly, it is well known that for a given flow of fluid through a fixed orifice, there will be a certain specific and repeatable pressure drop which will be constant as long as the flow and temperature remain constant. Where there are two identical orifices in series, such as provided in the orifices 38 in the respective pistons 36 and 47, each orifice will produce the same pressure drop and the temperature-viscosity relationship will be eliminated. It also follows that the movement of the pistons 36 and 47 will be identical under those aforementioned conditions. Accordingly, where a linear potentiometer is connected to the respective pistons 36 and 47, as shown in FIGS. 2 and 3, there will be the same electrical resistance for the same flow conditions, and if these electric resistances are compared for balance in a wheatstone-bridge type of device shown in FIG. 4 then, any differences in the electric resistances will actuate the latching relay 62 and actuate the sensor 27 and thereby close the solenoid valve 28.

A manually-controllable screw 66 is included in the valve 28 and can abut the end of the spool 31 to manually open the valve 28 and thereby permit lowering of the load 13 under manual control, if and when desired. Also, the solenoid 34 can be normally closed, and thus there is also an electric fail-safe arrangement such that if the electric power fails, then the spool 31 will go to the closed position.

Figure 5:
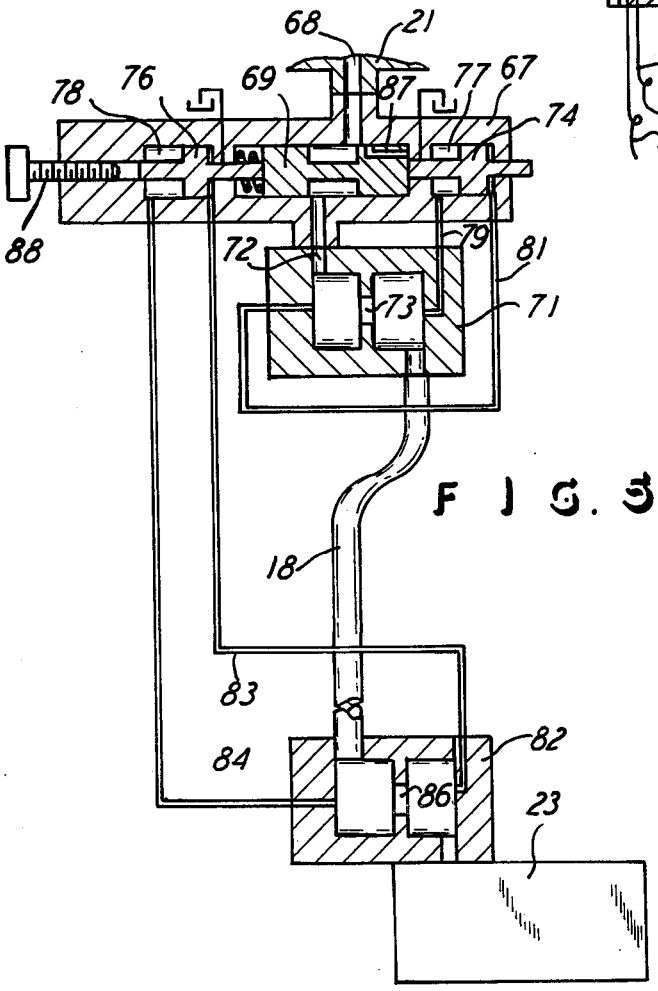
FIG. 5 is a sectional view of the valves useful in FIG. 1 and showing hydraulic, rather than electric, controls.

FIG. 5 shows another embodiment, and this is an all hydraulic arrangement and here the cylinder 21 has a hydraulic valve 67 mounted thereon and they have a passageway 68 extending therethrough and to the valve spool 69 shown. In this embodiment, a hydraulic sensor 71 is fluid connected through a passageway 72 with the valve 67, and it presents an orifice 73 for flow through the sensor 71. The valve 67 also has two pistons 74 and 76 slidable in chambers 77 and 78, respectively, in the valve 67. Sensor fluid lines 79 and 81 connect between opposite sides of the sensor 71 and opposite ends of the piston chamber 77; and another sensor 82 has fluid sensor lines 83 and 84 connected between opposite sides of the orifice 86 in the sensor 82 and to opposite sides of the valve chamber 78, as shown. Also, the hydraulic hose 18 is shown connected between the sensors 71 and 82, and this would be in the arrangement shown in FIG. 1. Also, the selector or control valve 23 is shown connected with the sensor 82.

Accordingly, with the flow conditions through the orifices 73 and 86 being regular, the load pistons 74 and 76 will remain in positions which will have the spool 69 remain open so that flow can go between the passageways 68 and 72 in the normal operation of the apparatus. However, if the flow conditions through the orifices 73 and 86 become unbalanced to a sufficient degree, such as caused by a break in the hose 18, then the differential forces on the load pistons 74 and 76 will cause a shifting of the spool 69 and thereby close the flow between the passageways 68 and 72 and again prevent the falling of the load 13, all as desired. The actual shifting of the spool 69 can be assisted or even effected by a fluid passageway 87 extending through the spool 69 and arranged to be in fluid-flow connection with the passageway 68 and the right-hand end of the spool 69, when the spool 69 is shifted slightly to the left, and thus the upstream or higher pressure in the passageway 68 will cause the spool 69 to firmly shift to the left and that is to its closed position, as desired. Again a manual release screw 88 is provided in the valve 67 to shift the spool 69 to the right when and if such action is desired.

Figure 6:
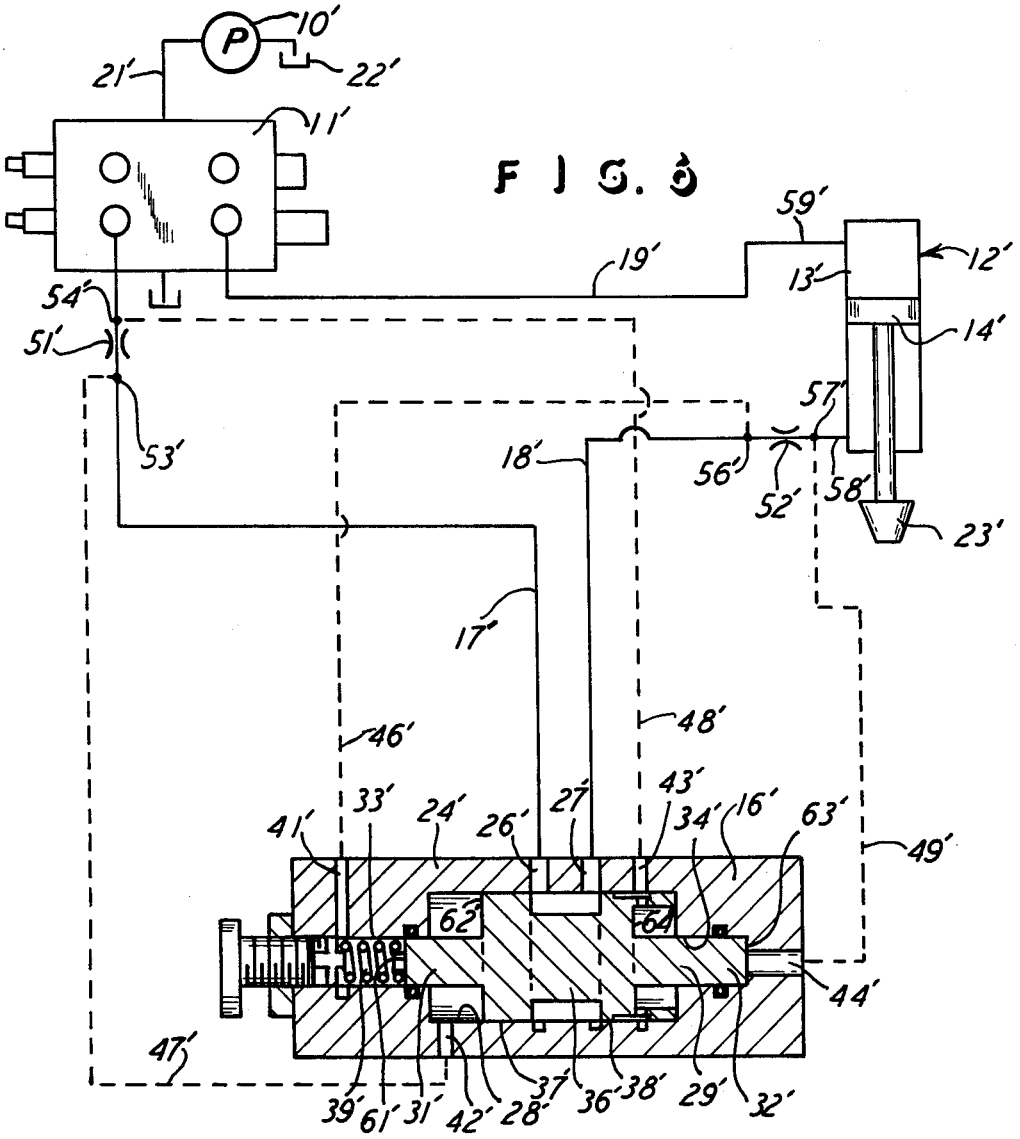
FIG. 6 is a diagrammatic sectional view of another embodiment of this invention.
Figure 7:
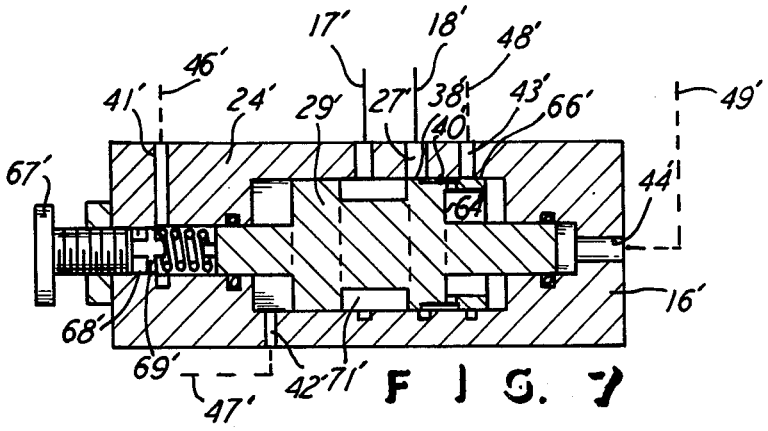
FIG. 7 is a sectional view of one of the elements shown in FIG. 6, but with the element being in a position different from that shown in FIG. 6.

FIGS. 6 and 7 show still another embodiment of this invention, and this is an all-hydraulic embodiment just as in connection with FIG. 5, and here the hydraulic system of this invention generally includes a hydraulic pump 10' and an operator controlled hydraulic valve 11' and a hydraulic responsive apparatus 12' which is shown herein to be in the form of a cylinder 13' and a piston 14' forming a cylinder assembly or hydraulic motor, and it shows a hydraulic interlock or safety valve 16'. The aforementioned hydraulic elements are all interconnected by hydraulic lines 17', 18', 19', and 21'. The usual hydraulic reservoir 22' is also shown, and it will be understood that the pump 10' operates between the reservoir 22' and the valve 11' to supply the valve 11' with pressurized hydraulic fluid, and the fluid is then distributed from the valve 11' and to the lines 17', 18', and 19', and thus the desired actuation of the hydraulic responsive apparatus 12' is accomplished. It will further be seen and understood that the apparatus 12' is shown to be supporting a diagrammatically shown and indicated weight 23', and this represents the weight or force exerted downwardly in hydraulically operated apparatus, such as a lifting bucket or a back hoe or a boom or the like all of which may be mounted on a tractor and be operated by the usual hydraulic apparatus employed in that type of installation, and that will be readily understood by one skilled in the art.

In the aforementioned arrangement, it will be also seen and understood by one skilled in the art that the apparatus 12' is reliant upon a hydraulic pressure in the line 18' in order to maintain the piston 14' and thus the work load 23' in the upwardly supported position. Of course if there is a reduction in the hydraulic pressure in the line 17', then the work load 23' will immediately fall, and it is this contingency and danger that the present invention is arranged to avoid. To do this, the present invention provides the system shown in FIG. 6, and it incorporates the interlock or safety valve 16' which is arranged to immediately respond to the loss of pressure in the hydraulic line 17', and the valve 16' acts to lock and retain the hydraulic pressure in the line 18' to avoid having the load 23' fall.

The safety or lock valve 16' has a housing 24' which has fluid ports 26' and 27' to which the lines 17' and 18', respectively, are connected. Therefore, it will be seen and understood that hydraulic fluid can flow from the valve 11' and through the line 17' and through the ports 26' and 27' and into the line 18' and to the hydraulic apparatus or motor 12', for the desired operation of the apparatus 12'. As mentioned, if there is a failure in the line 17', which is similar to the line 18 of FIG. 1, it is desired that pressure be retained in the apparatus 12' so that the work force, as represented by the weight 23', will not cause the apparatus 12' to move and lose its effort in supporting the weight 23'.

The housing 24' has a chamber 28' in which a movable spool or valve closure 29' is disposed, and the spool 29' can move to the left, as viewed in FIG. 6, in the chamber 28'. Thus, the spool 29' has cylindrical opposite end portions 31' and 32' which are piloted in housing openings 33' and 34', and the spool has an intermediate portion 36' which is snugly slidably disposed in the chamber 28' and actually presents fluid sealing circular surfaces 37' and 38' relative to the cylindrical chamber or bore 28'. A compression spring 39' extends between an end of the housing 24' and the spool portion 31' to urge the spool to the right, as viewed in FIG. 6.

The housing 24' has four more fluid ports 41', 42', 43', and 44'. These ports have hydraulic lines 46', 47', 48', and 49', respectively connected with the four previously mentioned ports, as shown. It will also be seen and understood that the pressurized hydraulic lines 17' and 18' have conventional flow restrictors 51' and 52' respectively diposed in the lines 17' and 18'. Further, it will be seen that the lines 46' through 49' are respectively connected with the lines 17' and 18', and the lines 46' through 49' are shown in dotted lines to most clearly describe them and to distinguish them from the lines 17' and 18' which are actually carrying the working hydraulic fluid. The lines 47' and 48' are shown connected at spaced-apart locations 53' and 54', respectively on the line 17' and on opposite sides of the flow restrictor 51'. Similarly, the lines 46' and 49' are respectively connected at locations 56' and 57' to the line 18' and on opposite sides of the flow restrictor 52'. With this arrangement, under normal operating conditions the fluid flow at the location 58' is the same as the fluid flow at the location 59'. However, if there is a failure in the long and primary line 17', then the quantity of flow at 58' will not be the same as the flow at 59', and the safety interlock valve 16' will sense that variance in flow and will actually cause a shut-off for the line 18' and thereby avoid a loss of the hydraulic pressure in the apparatus 12', all as desired.

To accomplish the aforementioned, it will be seen and understood that the interlock valve spool 29' has two pairs of shoulders or oppositely-faced surfaces 61', 62', and 63', 64'. It will of course be seen and understood that the area 64' is the projected area of the end of the spool 29' minus its projected surface 63', and that area 64' is the same as the area 62', and the area 61' is the same as the area 63'. The arrangement is therefore such that hydraulic fluid presented to the respective areas will cause hydraulic axial balancing of the spool 29'. Accordingly, fluid flow at the restrictors 51' and 52' is in proportion to the pressure differential on opposite fluid-flow sides of the restrictors 51' and 52' such that the fluid pressure at 54' plus the fluid pressure at 57' equals the fluid pressure at 53' plus the fluid pressure at 56'. It will now be noticed that the fluid pressures at 54' and 57' are ported to the right-hand portion of the lock valve 16' and are effective on the spool surfaces 64' and 63'; and the fluid pressures at 53' and 56' are ported to the left-hand side of the lock valve housing 24' and are effective on the spool surfaces 62' and 61'. Accordingly, in normal flow conditions, the spool will be in an equilibrium or shifted position to the right, as seen in FIG. 6, and thus there will be normal flow from the line 17' and through the housing 24' and into the line 18', all as desired.

However, when there is a break in the line 17', or some other failure in the pressure in the line 17', including shutting off of the pump 10', then there will be a reduction in the pressure in the line 47' and in the line 46', and that will cause the spool 29' to shift to the position shown in FIG. 7 where the port 27' is closed by the spool surface 28', except for the groove 40'. The port 43' is then fluid tightly sealed by the circular spool surface 66' which defines the outer circumference of the identified spool shoulder or surface 64', as mentioned. Also, any pressure at 27' goes through groove 40' and is effective on area 64'. With that arrangement, the pressure in the hydraulic line 18' is retained, and thus the apparatus 12' cannot move under the force of the load or weight 23', and thereby a safety feature is achieved.

Accordingly, the interlock valve 16' is arranged with its two ports 26' and 27' to connect to the working lines 17' and 18', and it is also arranged with its other ports which are the four ports 41', 42', 43', and 44' which are attached to the sensing hydraulic lines 46' through 47', respectively, and the spool therefore shifts under the change in fluid pressure at the opposite axial end of the spool 29', as seen and as described herein. Also, with the lock valve 16' being located adjacent to the work apparatus 12', as compared to its location relative to the valve 11', the system provides the safety and reacts in response to a break in the longer line 17', all as desired. Further, the fluid restrictors 51' and 52' provide a fluid flow and pressure differential on opposite sides of the respective restrictors, under the conditions mentioned above.

A manual release member 67' is threadedly mounted in an opening 68' in the housing 24', and it has an end 69' which extends toward the spool end portion 31'. When the spool 29' has shifted to its left position in FIG. 7, turning the manual control 67' to move it into the housing 24' will cause a shifting of the spool 29' to the right and thereby release the hydraulic interlock or safety condition, if and when such release is desired under the manual control of the manual screw 67' shown in the drawings. Of course when the spool 29' is shifted to the rightward position shown in FIG. 6, then it presents its recessed or passageway portion 71' which conducts the flow between the ports 26' and 27', as desired.

In this description, the similarities of the all-hydraulic apparatus as shown in the embodiments of FIGS. 5 and 6 will be apparent to one skilled in the art, and the orifices 73 and 86 of FIG. 5 serve the functions of the flow restrictors of 51' and 52' of FIG. 6, for instance. Also, FIG. 5 shows the valve 67 mounted in contact with the cylinder 21, and the valve 16' of FIG. 6 is also described as being located near or adjacent to the cylinder 13'. Likewise, the spools of the two valves of FIGS. 5 and 6 are similar in having shoulders oppositely faced and fluid-flow communication with the ports extending in the valve housing, for end-to-end fluid pressure balancing of the spool itself, and, in connection with FIG. 5, this arrangement is achieved with respect to the pistons 74 and 76 which bear on the main spool 69, and, as such, the embodiment of FIG. 5 is an equivalent of that shown in FIG. 6, so the pistons 74 and 76 are to be considered as extended portions of the spool 69. Still further, the valve 16' of FIG. 6, and the members 71 and 82 of FIG. 5 are all in the nature of sensors comparable to the sensors shown in the other embodiment described mainly in connection with FIGS. 1 through 4.

What is claimed is:

1. In an automatic hydraulic shut-off system having a hydraulic valve unit, a hydraulic responsive apparatus for applying a mechanical force in response to hydraulic pressure applied to said apparatus, and a hydraulic line connected between said valve unit and said apparatus, the impovement comprising a valve housing hydraulically connected with said hydraulic line and having a fluid passageway therein and a valve closure movably disposed therein for opening and closing said passageway and thereby controlling the flow of fluid in said hydraulic line, a differential pressure valve closure actuator at each end of said valve housing, two hydraulic flow sensors hydraulically connected with said hydraulic line in spaced-apart positions along said hydraulic line for receiving the flow of fluid between said valve housing and said valve unit, said sensors each having a restricted fluid-flow passageway and chambers at opposite ends of said passageways of said sensors for receiving all of the flow between said valve housing and said valve unit, and connecting fluid lines connected between said chambers of each of said sensors and a respective said valve closure actuator at opposite ends of said valve housing for moving said valve closure in said valve housing in response to an unbalance of fluid flow through said restricted fluid-flow passageways of said sensors to thereby have said valve closure close said valve housing passageway.

2. The automatic hydraulic shut-off system as claimed in claim 1, wherein said valve closure consists of a spool slidably disposed in said valve housing, and said spool being movable over said housing fluid passageway for opening and closing said passageway.

3. The automatic hydraulic shut-off system as claimed in claim 1, wherein said closure is a spool, said valve closure actuators including two pairs of oppositely faced shoulders, and said valve housing has four ports located respectively adjacent said four shoulders, and there being four of said connecting lines respectively connected with said four ports for directing fluid pressure to said four shoulders for shifting said spool.

4. The automatic hydraulic shut-off system as claimed in claim 1, wherein said flow sensors are respectively disposed adjacent said valve housing and said valve unit.

* * * * *